United States Patent [19]

Arnstein

[11] 4,072,284

[45] Feb. 7, 1978

[54] KITE BRACKET

[76] Inventor: Bennett Arnstein, 3049 W. 8th St., Los Angeles, Calif. 90005

[21] Appl. No.: 754,111

[22] Filed: Dec. 27, 1976

[51] Int. Cl.[2] ..... B64C 31/06

[52] U.S. Cl. ..... 244/153 R

[58] Field of Search ..... 244/153 R, 155 A; 403/234, 235, 237

[56] References Cited

U.S. PATENT DOCUMENTS

| | | | |
|---|---|---|---|
| 792,366 | 6/1905 | Taylor | 403/237 X |
| 2,117,095 | 5/1938 | Irwin | 403/237 |
| 3,534,932 | 10/1970 | Christoffel et al. | 244/153 R |
| 3,918,663 | 11/1975 | Cornelison, Jr. | 244/153 R |
| 3,963,200 | 6/1976 | Arnstein | 244/153 R |

FOREIGN PATENT DOCUMENTS

| | | | |
|---|---|---|---|
| 126,195 | 12/1901 | Germany | 244/153 R |

*Primary Examiner*—Galen L. Barefoot

[57] ABSTRACT

A kite bracket is disclosed whose shape is the combination of an open channel and a triangular pocket. The bracket is used on a kite having a main body formed of a thin flexible material with two leading edges which diverge rearwardly and with a strut attached to the main body adjacent to each leading edge. A longitudinal strut is attached to the main body, located symmetrically between the two leading edges, and a keel is attached to the lower side of the main body, essentially in line with the longitudinal strut. Two brackets are attached to the main body, one adjacent to each leading edge strut. The novel shape of the brackets is intended to receive and support the ends of a cross-strut which holds the kite open in position for flying, as well as to transmit a compressive force from the leading edge struts to the cross-strut.

1 Claim, 5 Drawing Figures

KITE BRACKET

FIELD OF THE INVENTION

This invention pertains generally to tailless kites and, more particularly, to the means for attaching the cross-strut in such a manner that it can easily be inserted to fly the kite, and easily removed to allow the kite to be rolled up for storage or shipping.

BACKGROUND OF THE INVENTION

The prior art bracket, disclosed in U.S. Pat. No. 3,534,932 which is hereafter referred to as Reference A, has a shape consisting of the combination of a hole and a triangular pocket, the walls of the hole completely surrounding the side strut and thus holding the bracket against the strut. The advantages of such a bracket cited by Ref. A are: low cost, strength, moisture resistance, and long life. In addition to these advantages, the bracket has several other advantages, namely:

1. Safety. Some kites use metal hooks attached to the ends of the cross strut as the means of securing the cross strut to the kite, the hooks engaging grommets secured to the kite body. A monolithic bracket with a triangular pocket is considerably safer.

2. Easy cross strut length adjustment. When the bracket is used on a home-made kite, the absence of metal hooks on the cross strut allows the kite builder to easily shorten the strut, if needed, to provide additional flying stability for the kite.

3. Long kite life. Some other methods of cross strut attachment require the kite to be severely stretched whenever the cross strut is inserted or removed. This continual stressing of the fabric of the kite body can considerably shorten the useful life of the kite.

4. Easy cross strut symmetry adjustment. A kite with improved flying qualities, such as disclosed in U.S. Pat. No. 3,963,200 which is hereafter referred to as Reference B, has the cross strut tied to the center strut. On such a kite the cross strut must be symmetrical so as to produce equal tension on both sides of the kite, and the bracket makes it easy to check the symmetry by simply grasping the brackets and pulling them away from each other, thus stretching the kite. With the kite held stretched and the cross strut centered, both ends of the strut will extend an equal amount into each bracket. The cross strut can easily be shifted until it is centered.

OBJECT OF THE INVENTION

The object of this invention is to make a simple but structurally significant modification of the prior art bracket so as to maintain all its advantages and provide in addition the following advantages:

1. Easy replacement of side struts in case of breakage.

2. Allow increased freedom of movement for the side struts, to permit independent articulation of the side struts which allows the kite to modify its shape to accommodate changing wind conditions. This enhances the flying qualities of the kite in gentle winds, and extends the range of wind speeds the kite can tolerate when used on a kite with improved flying qualities in stronger winds, such as disclosed in Ref. B.

This and other objects and features of advantage will become more apparent after studying the following description of my invention, together with the appended drawings.

Figure 1:
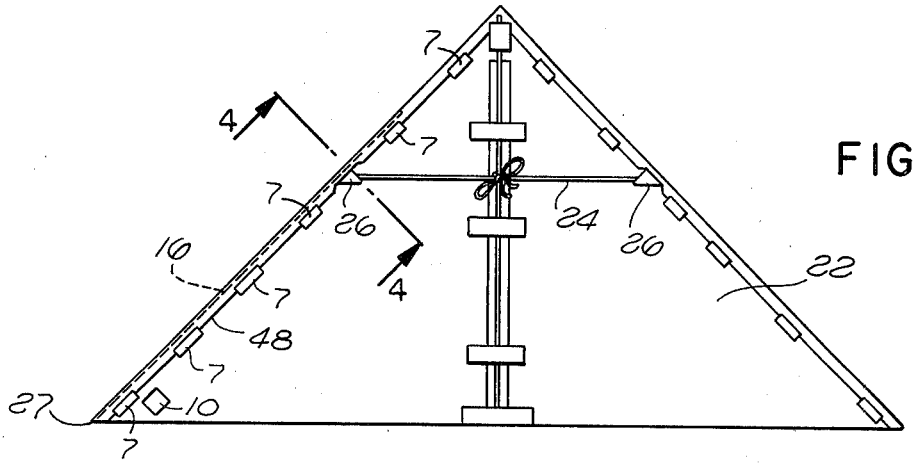
FIG. 1 is a top plan view of a kite using my novel bracket. The entire kite is described more fully in Ref. B.
Figure 4:
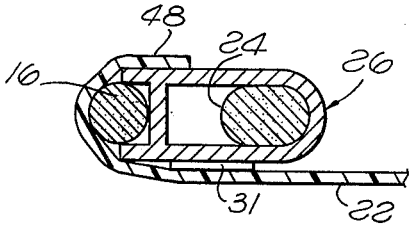
FIG. 4 is a section view taken on line 4—4 in FIG. 1.
Figure 3:
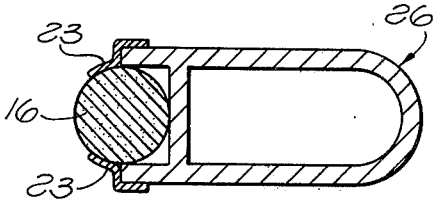
FIG. 3 is a section view taken on line 3—3 in FIG. 2.
Figure 5:
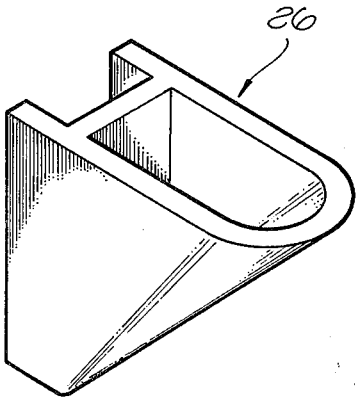
FIG. 5 is a perspective drawing of my novel bracket.
Figure 2:
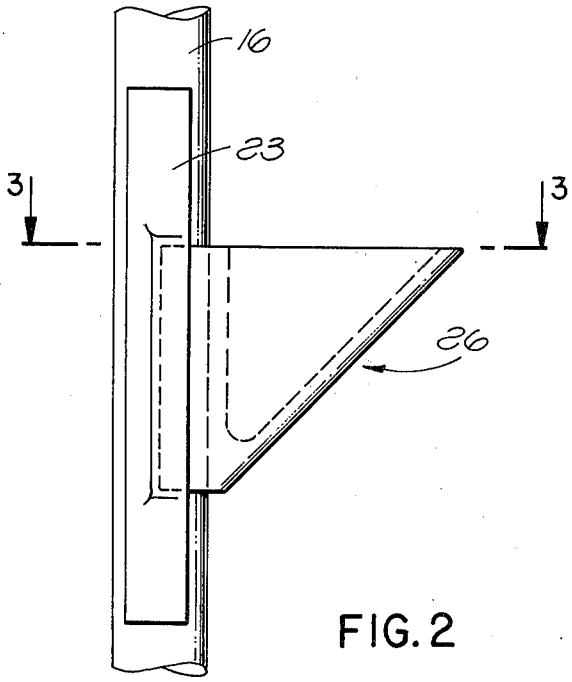
FIG. 2 shows a portion of one side strut 16 removed from the kite, and illustrates one method of attaching my bracket to the kite by attaching it to the side strut 16 with two strips of adhesive tape 23. Only one strip of tape 23 is visible in this figure, both strips appearing in FIG. 3.

DETAILED DESCRIPTION OF THE DRAWINGS:

Two different methods of attaching my bracket to the kite are illustrated in the appended figures, one method being shown in FIGS. 2 and 3, and a second method being shown in FIG. 4. The method shown in FIGS. 2 and 3 is not preferred, as it exhibits the advantages of my novel bracket to only a small degree, while remaining essentially equivalent to the prior art. The method shown in FIG. 4 is the preferred method for attaching my novel bracket to the kite. In FIG. 4 the bracket is shown attached directly to the body of the kite 22 with a single piece of double-sided adhesive tape 31. When this method is employed, the trailing end of flap 48 is sealed against the trailing edge of the kite near wing tip 27, thus forming a triangular pocket which positively locates and secures the trailing end of side strut 16. Side strut 16 is then held firmly against bracket 26 by means of flap 48 and adhesive tape 7. Side strut 16 should also be secured to body 22 with a single piece of adhesive tape placed anywhere along its length, to prevent it from sliding forward out of the triangular pocket at wing tip 27. With the bracket attachment shown in FIG. 4 a broken side strut is easily replaced by unsealing flap 48 (except do not unseal the triangular pocket at wing tip 27), removing the broken strut, replacing it with a new strut, and re-sealing flap 48. The kite should then be balanced indoors as described in Ref. B. (See balance weight 10 in FIG. 1.)

As can be seen in FIG. 4, side strut 16 is not attached directly to bracket 26 so that the strut can twist relative to the bracket and simultaneously move slightly out of the channel section of the bracket. This will happen only when dictated by the forces acting on the kite. When the side strut does not twist relative to the bracket it remains firmly but movably held against the bracket inside the open channel section.

It should now be obvious that the object of my invention has been achieved.

I claim:

1. I claim a kite structure containing but not limited to the following elements: a main body portion formed from a thin flexible material with two leading edges diverging rearwardly; two wing struts attached to the main body, one adjacent to each leading edge; two brackets attached to the main body, one adjacent to each wing strut; each bracket being a monolithic structure whose shape is the combination of an open channel and a triangular pocket, the side walls of the channel being extended to form the side walls of the triangular pocket which meet and join to form the inboard boundary of the triangular pocket, the base of the channel forming the outboard boundary of the triangular pocket; attaching means for securing said main body to the side wall of said bracket; and further attaching means for holding said leading edge in a folded position over said wing strut whereby said wing strut is nonrigidly held in said open channel.

* * * * *